US012029939B2

(12) United States Patent
Smits

(10) Patent No.: US 12,029,939 B2
(45) Date of Patent: Jul. 9, 2024

(54) BICYCLE TRAINER AND METHOD OF ITS OPERATION

(71) Applicant: Tacx B.V., Wassenaar (NL)

(72) Inventor: Martin Smits, Wassenaar (NL)

(73) Assignee: Tacx B.V., Oegstgeest (NL)

( * ) Notice: Subject to any disclaimer, the term of this patent is extended or adjusted under 35 U.S.C. 154(b) by 546 days.

(21) Appl. No.: 16/644,768

(22) PCT Filed: Sep. 17, 2018

(86) PCT No.: PCT/NL2018/050608
§ 371 (c)(1),
(2) Date: Mar. 5, 2020

(87) PCT Pub. No.: WO2019/059759
PCT Pub. Date: Mar. 28, 2019

(65) Prior Publication Data

US 2021/0060379 A1 Mar. 4, 2021

(30) Foreign Application Priority Data

Sep. 21, 2017 (NL) ..... 2019598

(51) Int. Cl.
*A63B 22/06* (2006.01)
*A63B 21/005* (2006.01)
*A63B 24/00* (2006.01)

(52) U.S. Cl.
CPC ..... *A63B 22/0605* (2013.01); *A63B 21/0058* (2013.01); *A63B 24/0087* (2013.01); *A63B 2024/009* (2013.01)

(58) Field of Classification Search
CPC ..... A63B 22/0605; A63B 21/0058; A63B 24/0087; A63B 2024/009;
(Continued)

(56) References Cited

U.S. PATENT DOCUMENTS 5,690,582 A * 11/1997 Ulrich ..... A63B 22/02 482/52
6,244,988 B1 * 6/2001 Delman ..... A63B 71/0622 482/901

(Continued)

FOREIGN PATENT DOCUMENTS

WO WO2017129275 * 8/2017 ..... A63B 24/00

OTHER PUBLICATIONS

International Search Report and Written Opinion from corresponding application PCT/NL2018/050608 filed Sep. 17, 2018 entitled Bicycle Trainer and its Method of Operation.

*Primary Examiner* — Andrew S Lo
*Assistant Examiner* — Andrew M Kobylarz
(74) *Attorney, Agent, or Firm* — Samuel M. Korte; Max M. Ali

(57) ABSTRACT

Bicycle trainer comprising a seat, handlebars and rotatable pedals, and an electronically variable brake acting directly or indirectly on the rotatable pedals with a braking resistance that depends on a predetermined setting of a computer-controller, which predetermined setting is variable and depends on selected parameters to reflect simulated cycling conditions comprising at least one of a road, wind conditions and a cyclist, wherein the bicycle trainer excludes a flywheel and includes a variable-ratio transmission system and that the predetermined setting of the braking resistance also depends on a setting or change of setting of the variable-ratio transmission system so as to simulate a level of inertia or change of inertia as experienced by an outdoor cyclist when changing the variable-ratio transmission system.

12 Claims, 1 Drawing Sheet

(58) Field of Classification Search
CPC ..... A63B 2071/065; A63B 21/225; A63B 2071/0675; A63B 69/16
See application file for complete search history.

(56) References Cited

U.S. PATENT DOCUMENTS

| | | | | |
|---|---|---|---|---|
| 10,376,731 | B2 * | 8/2019 | Fuchs | B60L 15/2009 |
| 11,707,623 | B2 * | 7/2023 | Golan | A61N 1/3611 607/60 |
| 2007/0042868 | A1 * | 2/2007 | Fisher | G16H 20/30 482/902 |
| 2007/0149364 | A1 * | 6/2007 | Blau | A63B 24/00 482/8 |
| 2007/0179024 | A1 * | 8/2007 | Maenpaa | A63B 71/0622 482/57 |
| 2007/0281828 | A1 * | 12/2007 | Rice | A63B 22/0605 482/4 |
| 2009/0011907 | A1 * | 1/2009 | Radow | B62M 3/00 482/57 |
| 2011/0263384 | A1 * | 10/2011 | Drazan | A63B 21/0055 482/2 |
| 2012/0088634 | A1 * | 4/2012 | Heidecke | A63B 22/0005 482/92 |
| 2013/0059698 | A1 * | 3/2013 | Barton | A63B 71/0622 482/63 |
| 2019/0358483 | A1 * | 11/2019 | Fuchs | B62M 19/00 |
| 2021/0046373 | A1 * | 2/2021 | Smith | A63B 71/0622 |
| 2021/0060379 | A1 * | 3/2021 | Smits | A63B 22/0605 |
| 2021/0060380 | A1 * | 3/2021 | Hawkins, III | A63B 22/0046 |

* cited by examiner

BICYCLE TRAINER AND METHOD OF ITS OPERATION

RELATED APPLICATIONS

The present application is a U.S. National Stage filing under 35 U.S.C. § 371 of co-pending International Patent Application No. PCT/NL2018/050608, entitled "Bicycle Trainer and Method of its Operation," having an International filing date of Sep. 17, 2018, designating the United States and published in English on Apr. 26, 2018 as publication WO 2019/059759, which claims the benefit of Dutch Patent Application No. 2019598, entitled "Bicycle Trainer and Method of its Operation," filed on Sep. 21, 2017. The contents of the above referenced applications are incorporated herein by reference in their entirety.

BACKGROUND

The invention relates to a bicycle trainer comprising a seat, handlebars and rotatable pedals, and an electronically variable brake acting directly or indirectly on the rotatable pedals with a braking resistance that depends on a predetermined setting by a computer-controller, which predetermined setting is variable and depends on selected parameters to reflect simulated cycling conditions comprising at least one of a road, wind conditions and a cyclist. The invention also relates to a method to operate such a bicycle trainer.

US2007/0179024 teaches such a method and bicycle trainer, which includes a flywheel.

From http: //www.cyclus2.com/en/track-simulation.htm it is known to control several factors to improve the real-life experience of a training exercise by calculating and setting the braking resistance during an indoor training as how they appear in a real scenario, depending on: air resistance, downhill force, and rolling friction.

The calculation, which is directly bearing on the brake torque for the setting of the load for the athlete, is carried out in real time and in dependence of the cycler's velocity (to reflect air resistance), weight and material.

US2013/0059698 teaches a stationary bicycle trainer including a simulation system for simulating real-world terrain based on environmental and other real-world conditions. The bicycle trainer includes a resistance mechanism that is adjusted based on changes in simulated slope, and by amounts simulating actual frictional and gravitational forces. A simulated speed of the cyclist, as well as speed and direction of the simulated wind, are used to determine a simulated airspeed. The bicycle trainer takes into account actual or approximate physical information of the user in determining the real-world conditions that are simulated, including the height, weight, shape, and/or rising position of the cyclist. This known bicycle trainer comprises a flywheel, or alternatively an electric motor to provide an adjusted additional resistance to the resistance mechanism. The electric motor which may be used to simulate the flywheel may be directly or indirectly connected to a crankshaft of the pedals, and the applied current to the motor may apply resistance at the crankshaft in addition to the resistance applied by the resistance mechanism. Based on the amount of current or resistance provided, the degree to which rotation of the crankshaft is hindered may vary.

SUMMARY

With the invention it is aimed to further improve the real-life experience with such a bicycle trainer and with its method of operation.

For that purpose the method of operating the bicycle trainer as well as the bicycle trainer of the invention are embodied with the features of one or more of the appended claims.

In a first aspect of the invention the bicycle trainer excludes a flywheel and includes a variable-ratio transmission system and the predetermined setting of the braking resistance is made to depend on a setting or change of setting of the variable-ratio transmission system so as to simulate a level of inertia or change of inertia as experienced by an outdoor cyclist when changing the variable-ratio transmission system. This tremendously improves the real-life experience of the bicycle trainer in comparison with prior art systems that merely change the amount of braking resistance, and leave the amount of inertia experienced by the user unaffected. The bicycle trainer of the invention can quicker and therefore more effectively simulate an outdoor biking experience due to the absence of the flywheel and the simulation thereof with the variable-ratio transmission system.

Advantageously the variable-ratio transmission system determines the ratio of a rotational speed of the pedals in relation to a virtual forward speed of the cyclist. When changing to a higher gear this results into a lower rotational speed of the pedals with the same forward speed, whereas changing to a lower gear results into a higher rotational speed of the pedals with the same forward speed of the cyclist. This also accords to what a real-life cyclist experiences outdoors when changing gear ratio, wherein the forward speed is initially the same immediately before and immediately after changing of gear.

To simulate the experience during changing of gear it is further beneficial that the predetermined setting of the braking resistance is time variable with variations with a predetermined frequency during a change of setting of the virtual variable-ratio transmission system corresponding to what is experienced by an outdoor cyclist when changing the variable-ratio transmission system. The variations with the predetermined frequency correspond to a virtual chain derailing from one sprocket wheel to another. Accordingly the variations in the braking resistance cease when the change of gear ratio has been completed.

The real-life experience is further promoted by the feature that the bicycle trainer is provided with a visual indicator reflecting the setting or change of setting of the variable-ratio transmission system.

The invention will hereinafter be further elucidated with reference to the drawing of schematically and comparatively showing a bicycle trainer according to the prior art and according to invention.

DETAILED DESCRIPTION

The applicant remarks that in principle it is unnecessary to show with reference to a drawing the construction of a bicycle trainer that comprises a seat, handlebars and rotatable pedals. These types of bicycle trainers are well known from day to day life, as well as for instance from prior art document US2013/0059698.

Figure 1:
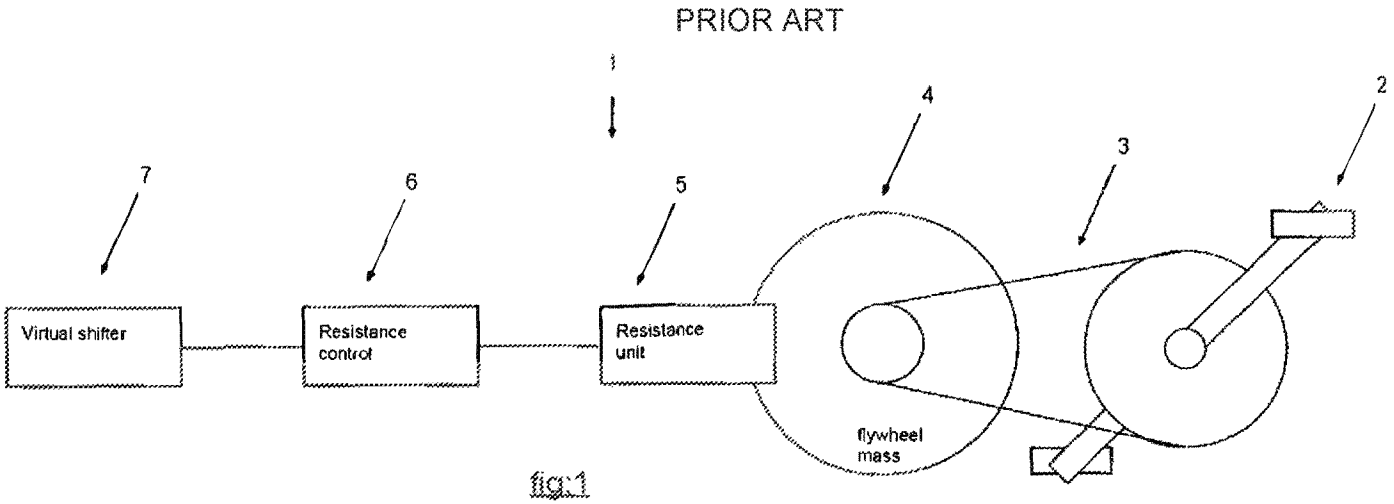
FIG. 1 shows a diagram of a bicycle trainer according to the prior art.

FIG. 1 schematically shows an example of a bicycle trainer 1 of the prior art with rotatable pedals 2, and a chain 3 that drives a flywheel 4. The flywheel 4 may also be replaced and simulated by a motor/generator 8 driven by a controller 6 as shown in FIG. 2.

Figure 2:
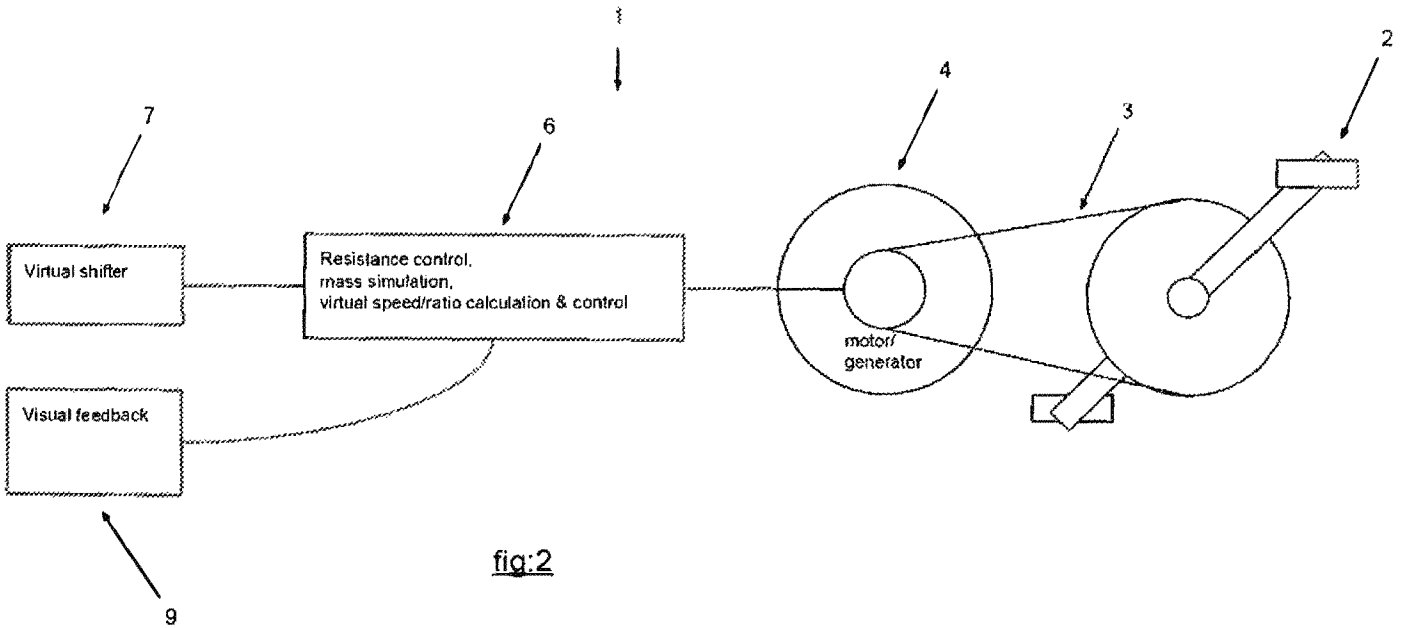
FIG. 2 shows a diagram of a bicycle trainer according to the invention.

In the embodiment of FIG. 1 an electronically variable brake 5 acts on the flywheel 4 (or as FIG. 2 shows the controller 6 drives the motor/generator 8 to simulate a brake), and thus indirectly acts on the rotatable pedals 2 with a braking resistance that depends on a predetermined setting, in both cases said predetermined setting being determined with a computer controller 6. The predetermined setting is variable and depends on selected parameters to reflect simulated cycling conditions comprising at least one of a road, wind conditions and a cyclist.

In the prior art it is also possible that the bicycle trainer 1 includes a virtual variable-ratio transmission system 7 which may influence the setting of the braking resistance of the brake 5 (or the setting of the simulated braking resistance as provided by controller 6 and the motor/generator 8 as shown in FIG. 2), however leaving the inertia of the flywheel mass (or the inertia of the flywheel simulated by the controller 6 and the motor/generator 8) unaffected.

Conversely FIG. 2 shows the bicycle trainer 1 of the invention, which like the prior art trainer comprises rotatable pedals 2, and a chain 3 but which unlike the prior art does not have a flywheel. In the invention the chain 3 always drives a motor/generator 8 which is controlled by a computer controller 6, which controller 6 uses as one of its inputs the setting of the virtual variable-ratio transmission system 7.

According to the invention the computer controller 6 is embodied to generate with the motor/generator 8 a level of inertia or change of inertia as experienced by an outdoor cyclist that depends on the setting or change of setting of the variable ratio transmission system 7. Indeed changing the level of inertia or change of inertia as generated with the controller 6 and the motor/generator 8 without employing a separate flywheel is what differentiates the invention from the prior art, and which supports the real-life experience by a user of the bicycle trainer 1 of the invention.

Advantageously the variable-ratio transmission system 7 determines the ratio of a rotational speed of the pedals 2 in relation to a virtual forward speed of the cyclist. Accordingly changing to a lower gear results into a higher rotational speed of the pedals 2 with the same forward speed of the cyclist. Conversely changing to a higher gear results into a lower rotational speed of the pedals 2 with the same forward speed of the cyclist. Together this enhances the real-life than a cyclist experiences outdoors, wherein indeed the forward speed is initially the same immediately before and immediately after changing of gear.

In order to simulate the feeling of the cyclist during changing gear, it is preferable that the predetermined setting of the braking resistance is time variable with variations with a predetermined frequency during a change of setting of the virtual variable-ratio transmission system 7 corresponding to what is experienced by an outdoor cyclist when changing the variable ratio transmission system 7. This time variable braking resistance simulates the derailing of a virtual chain that connects to the pedals when moving from one sprocket wheel to the other.

The computer controller 6 of the bicycle trainer 1 further preferably has a visual display unit 9 to show the user the setting or change of setting of the variable ratio transmission system 7.

Beneficially the predetermined setting of the braking resistance is time variable with variations with a predetermined frequency corresponding to what is experienced by an outdoor cyclist when changing the variable ratio transmission system.

Although the invention has been discussed in the foregoing with reference to an exemplary embodiments relating to the bicycle trainer of the invention, the invention is not restricted to these particular embodiments which can be varied in many ways without departing from the invention. The discussed exemplary embodiments shall therefore not be used to construe the appended claims strictly in accordance therewith. On the contrary the embodiments are merely intended to explain the wording of the appended claims without intent to limit the claims to these exemplary embodiments. The scope of protection of the invention shall therefore be construed in accordance with the appended claims only, wherein a possible ambiguity in the wording of the claims shall be resolved using these exemplary embodiments.

What is claimed is:

1. A bicycle trainer comprising:
a seat;
handlebars;
a motor;
rotatable pedals coupled with the motor;
an electronically variable brake acting on the motor to simulate real-world cycling conditions; and
a computing element in electrical communication with the electronically variable brake, the computing device configured to:
identify a predetermined setting of the braking resistance to simulate a change of inertia that would be experienced by an outdoor cyclist when making a change to a selected gear of a bicycle while riding outdoors, and
output a control signal to the electronically variable brake including the predetermined setting of the braking resistance;
wherein, once a selected gear of the bicycle trainer is changed, the electronically variable brake generates a braking resistance on the motor that corresponds to the identified predetermined setting and simulates the derailing of a virtual chain that connects to the rotatable pedals when moving from a first sprocket wheel to a second sprocket wheel of a bicycle while riding outdoors.

2. The bicycle trainer of claim 1, wherein the computing element is further configured to determine a ratio of a rotational speed of the pedals in relation to a virtual forward speed of a cyclist using the bicycle trainer.

3. The bicycle trainer of claim 1, wherein the predetermined setting of the braking resistance is time variable with variations of a predetermined frequency during a change of setting of a virtual gear corresponding to the movements sensed by the outdoor cyclist when making a change to a virtual variable-ratio transmission system.

4. The bicycle trainer of claim 1, further comprising a visual indicator presenting one of a current setting of a virtual variable-ratio transmission system or a change of setting of the variable-ratio transmission system.

5. A bicycle trainer comprising:
a seat;
handlebars;
a motor;
rotatable pedals coupled with the motor;

an electronically variable brake acting on the motor to simulate real-world cycling conditions; and a computing element in electrical communication with the electronically variable brake, the computing device configured to:

determine a virtual forward speed of a cyclist engaged in a cycling activity, identify a predetermined setting of the braking resistance to simulate a level of inertia and a change of inertia that would be experienced by an outdoor cyclist when rotating the pedals and making a change to a selected gear of a bicycle while riding outdoors corresponding to the determined forward speed, and output a control signal to the electronically variable brake including the predetermined setting of the braking resistance;

wherein, once a selected gear of the bicycle trainer is changed, the electronically variable brake generates a braking resistance on the motor that corresponds to the identified predetermined setting and simulates the derailing of a virtual chain that connects to the rotatable pedals when moving from a first sprocket wheel to a second sprocket wheel of a bicycle while riding outdoors.

6. The bicycle trainer of claim 5, wherein a virtual variable-ratio transmission system determines a ratio of a rotational speed of the pedals in relation to a virtual forward speed of the cyclist using the bicycle trainer.

7. The bicycle trainer of claim 5, wherein the predetermined setting of the braking resistance is time variable with variations of a predetermined frequency during a change of setting of a virtual gear corresponding to the movements sensed by the outdoor cyclist when making a change to a virtual variable ratio transmission system.

8. The bicycle trainer of claim 5, further comprising a visual indicator presenting one of a current setting of a virtual variable-ratio transmission system or a change of setting of the variable-ratio transmission system.

9. The bicycle trainer of claim 2, wherein changing to a lower virtual gear results in a higher rotational speed of the pedals.

10. The bicycle trainer of claim 2, wherein changing to a higher virtual gear results in a lower rotational speed of the pedals.

11. The bicycle trainer of claim 6, wherein changing to a lower virtual gear results in a higher rotational speed of the pedals.

12. The bicycle trainer of claim 6, wherein changing to a higher virtual gear results in a lower rotational speed of the pedals.

* * * * *